US010094080B2

(12) United States Patent
Utz

(10) Patent No.: US 10,094,080 B2
(45) Date of Patent: Oct. 9, 2018

(54) TRAFFIC CONE

(71) Applicant: Terry Utz, Murrieta, CA (US)

(72) Inventor: Terry Utz, Murrieta, CA (US)

( * ) Notice: Subject to any disclaimer, the term of this patent is extended or adjusted under 35 U.S.C. 154(b) by 62 days.

(21) Appl. No.: 15/041,238

(22) Filed: Feb. 11, 2016

(65) Prior Publication Data

US 2016/0230356 A1 Aug. 11, 2016

Related U.S. Application Data

(60) Provisional application No. 62/114,988, filed on Feb. 11, 2015.

(51) Int. Cl.
*E01F 9/688* (2016.01)
*E01F 9/594* (2016.01)
*E01F 9/654* (2016.01)

(52) U.S. Cl.
CPC ..... *E01F 9/654* (2016.02); *E01F 9/594* (2016.02); *E01F 9/688* (2016.02)

(58) Field of Classification Search
CPC . E01F 9/654; E01F 9/688; E01F 9/588; E01F 9/594
USPC ..... 116/63 P, 63 C
See application file for complete search history.

(56) References Cited

U.S. PATENT DOCUMENTS 3,334,554 A * 8/1967 Adams ..... E01F 9/512 116/35 R
3,499,413 A 3/1970 Heard
4,157,210 A * 6/1979 Mesman ..... G02B 5/12 116/63 P
4,687,369 A * 8/1987 McDonald ..... E01F 9/688 116/63 P
4,772,869 A * 9/1988 Grammas et al. ..... B60Q 7/00 116/63 C
5,030,029 A * 7/1991 Johnsen ..... E01F 13/02 116/202
5,115,343 A * 5/1992 Bennett ..... G02B 5/124 116/63 C
5,168,827 A * 12/1992 Junker ..... E01F 9/688 116/63 C
5,195,453 A * 3/1993 McGibbon, II ..... E01F 9/688 116/63 C (Continued)

FOREIGN PATENT DOCUMENTS

AU 2012101739 1/2013
CN 202466443 10/2012

(Continued)

OTHER PUBLICATIONS

Utz, Traffic Cone, PCT Application Serial No. PCT/US17/17654, Filed on Feb. 13, 2017, International Search Report and Written Opinion, dated May 8, 2017, 12 pages.

*Primary Examiner* — R. A. Smith
(74) *Attorney, Agent, or Firm* — Schmeiser, Olsen & Watts LLP

(57) ABSTRACT

A traffic cone is provided. The traffic cone includes a triangular base with feet coupled to a bottom side of the triangular base. The traffic cone further includes a cone body having eight surfaces forming an octagonal cone shape coupled to the triangular base, wherein the cone body extends from a top side of the triangular base. Additionally, the traffic cone includes at least one reflective member coupled around a perimeter of the cone body.

12 Claims, 2 Drawing Sheets

(56) References Cited

U.S. PATENT DOCUMENTS

| | | | | | |
|---|---|---|---|---|---|
| 5,389,921 | A * | 2/1995 | Whitton et al. | E01F 9/662 | 248/156 |
| 6,014,941 | A * | 1/2000 | Bent et al. | E01F 9/688 | 116/63 P |
| 6,095,716 | A * | 8/2000 | Kulp et al. | E01F 9/688 | 116/63 C |
| 6,182,600 | B1 * | 2/2001 | Brown et al. | E01F 9/688 | 116/63 C |
| 7,007,630 | B2 | 3/2006 | Garcia | | |
| D704,585 | S * | 5/2014 | Kuo | D10/113.2 | |
| 9,940,839 | B2 * | 4/2018 | Stafford et al. | G08G 1/097 | |
| 2005/0076822 | A1 * | 4/2005 | Levine | E01F 9/654 | 116/63 C |
| 2007/0012237 | A1 | 1/2007 | Nielsen | | |
| 2014/0104833 | A1 | 4/2014 | Alsaffar | | |
| 2014/0283733 | A1 * | 9/2014 | Archer | E01F 9/654 | 116/63 C |

FOREIGN PATENT DOCUMENTS

| | | | | |
|---|---|---|---|---|
| CN | 202809516 | | 3/2013 | |
| FR | 2666105 | B3 * | 12/1992 | E01F 9/594 |
| FR | 2871482 | | 12/2005 | |
| GB | 875635 | A * | 8/1961 | E01F 9/677 |
| GB | 2205341 | A * | 12/1988 | E01F 9/688 |
| JP | 2008174963 | A * | 7/2008 | E01F 13/02 |
| MU | 8302075-6 | | 6/2005 | |
| WO | 2015155457 | | 10/2015 | |

* cited by examiner

TRAFFIC CONE

CROSS REFERENCE TO RELATED APPLICATION[S]

This application claims priority to U.S. Provisional Patent Application entitled "TRAFFIC CONE," Ser. No. 62/114,988, filed Feb. 11, 2015, the disclosure of which is hereby incorporated entirely herein by reference.

BACKGROUND OF THE INVENTION

Technical Field

This invention relates generally to a traffic cone and more particularly for an improved triangle base traffic cone with polygonal cone body.

State of the Art

According to the Manual on Uniform Traffic Control Devices (MUTCD), "Cones shall be predominantly orange and shall be made of a material that can be struck without causing damage to the impacting vehicle. For daytime and low-speed roadways, cones shall be not less than 18 inches in height. When cones are used on freeways and other high-speed highways or at night on all highways, or when more conspicuous guidance is needed, cones shall be a minimum of 28 inches in height. For nighttime use, cones shall be retroreflectorized or equipped with lighting devices for maximum visibility. Retroreflectorization of cones that are 28 to 36 inches in height shall be provided by a 6-inch wide white band located 3 to 4 inches below the 6-inch band. Retroreflectorization of cones that are more than 36 inches in height shall be provided by horizontal, circumferential, alternating orange and white retroreflective stripes that are 4 to 6 inches wide. Each cone shall have a minimum of two orange and two white stripes with the top stripe being orange. Any non-retroreflective spaces between the orange and white stripes shall not exceed 3 inches in width."

Conventional traffic cones have a square base and circular conical shape body. Some cones include reflective portions of the circular conical shaped body. The cones are heavier and the reflective portions are limited.

Accordingly, there is a need in the field of traffic cones for an improved traffic cone.

DISCLOSURE OF THE INVENTION

The present invention relates to a traffic cone with a triangle base and polygonal cone shaped cone body.

An embodiment includes a traffic cone comprising a base; and a cone body coupled to the base and extending from a top side of the base, wherein the cone body comprises five or more surfaces forming a polygonal cone shape.

Another embodiment includes a traffic cone comprising: a triangular base; a cone body having eight surfaces forming an octagonal cone shape coupled to the triangular base, wherein the cone body extends from a top side of the triangular base; at least one reflective member coupled around a perimeter of the cone body; and feet coupled to a bottom side of the triangular base.

Yet another embodiment includes a method of using a traffic cone comprising: placing a cone in a roadway, wherein the cone comprises a triangular base; a cone body coupled to the base and extending from a top side of the triangular base and at least one reflective member coupled around a perimeter of the cone body, wherein the cone body comprises five or more surfaces forming a polygonal cone shape; reflecting light from the at least one reflective member from various angles corresponding to the angle of the surfaces of the cone body; and directing traffic by use of the cone.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Embodiments of the present invention relate to a traffic cone with a triangle base and polygonal cone shaped cone body.

Figure 1:
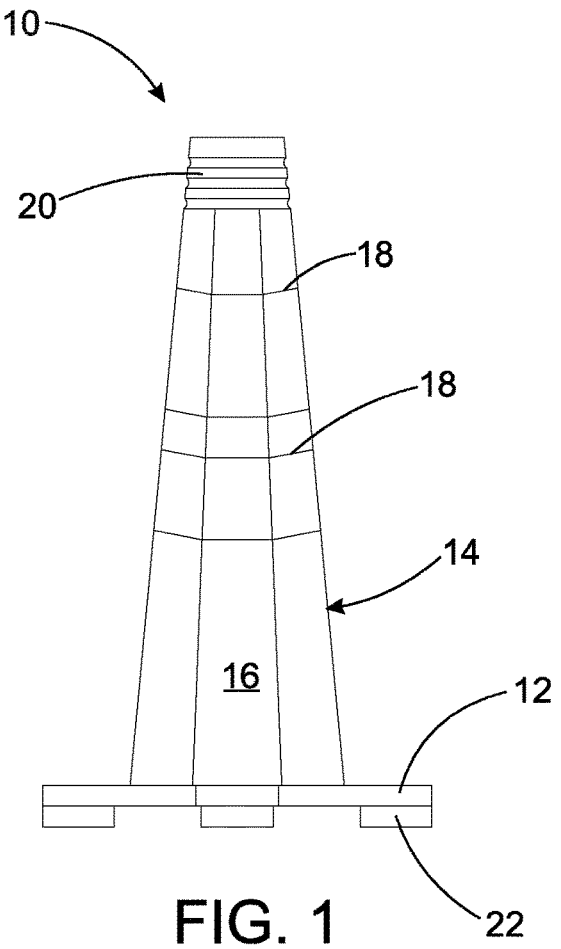
FIG. 1 is a side view of a traffic cone according to an embodiment.
Figure 2:
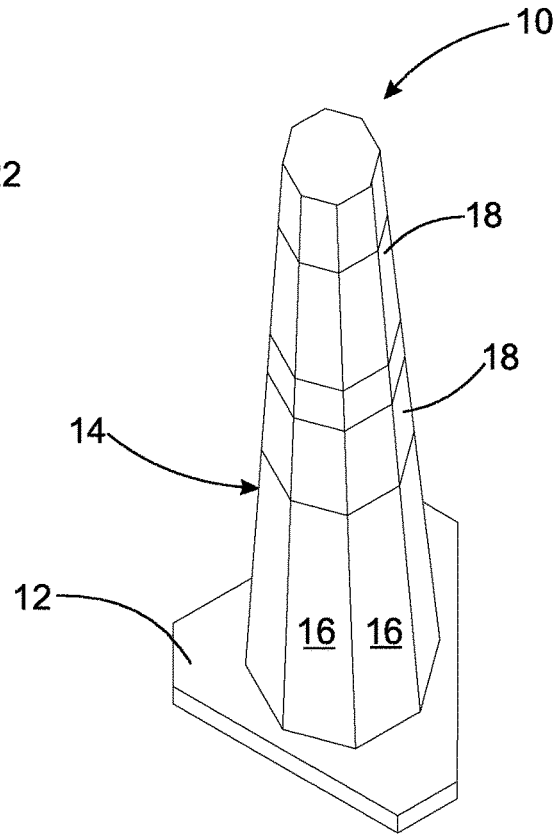
FIG. 2 is an isometric view of a traffic cone according to an embodiment.
Figure 3:
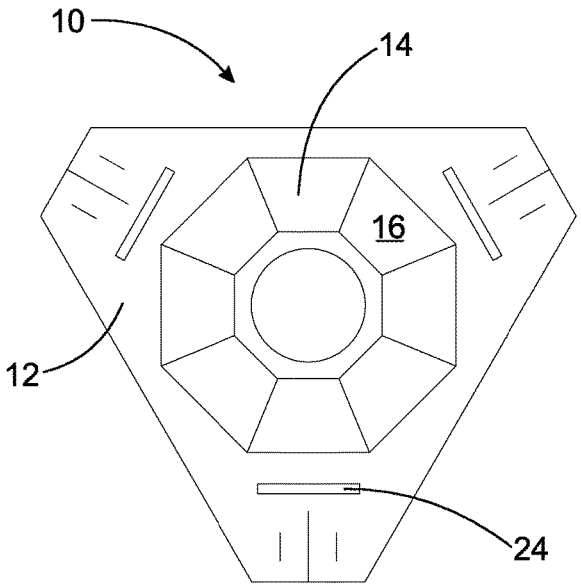
FIG. 3 is a top view of a traffic cone according to an embodiment.
Figure 4:
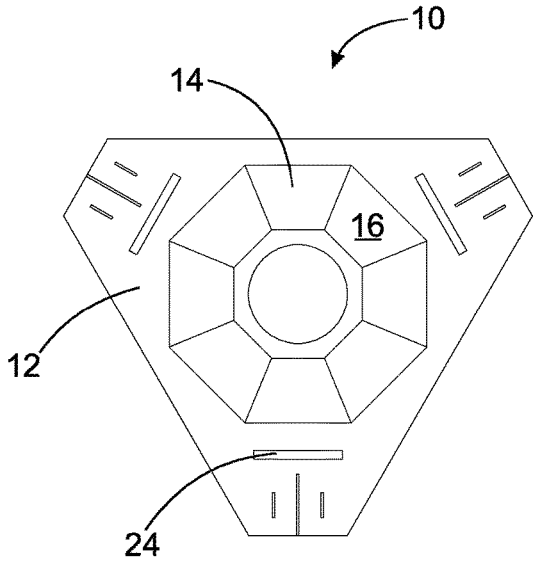
FIG. 4 is a bottom view of a traffic cone according to an embodiment.

As shown in FIGS. 1-4, a traffic cone 10 includes a triangle base 12 and a cone body 14. The cone body 14 includes a plurality of surfaces 16 that form the cone body 14. The surfaces 16 are tapered in order to form the cone body 14. The surfaces 16 form a polygonal cone. For example, as shown in FIGS. 2-4 depict a cone body 14 with eight surfaces 16 to form an octagonal cone shaped a cone body 14. While the traffic cone 10 is shown with eight surfaces 16, any number of surfaces may be used, such as, but not limited to, five, six, seven, eight, nine, ten, eleven, twelve and so forth, so long as it is a polygon with more than four sides.

The polygonal shape of the cone body 14 allows for light be incident on the cone at varying angles, and with a flat surface, it provides a larger surface area of reflective member 18, thereby making it more visible, particularly at night. Because of the polygonal shape, the traffic cone 10 may be placed in any orientation and the varying angles of the surfaces 16 will provide a reflective surface to light from vehicles to more easily reflect a larger surface area of the reflective member 18 in order to alert a driver of the traffic cone and the impending traffic roadway condition, closure, or warning. This is superior to a round cone that only provides a small rounded surface wherein the light is reflected in various angles from the surface, resulting in lower viewing ability compared to embodiments of the present invention. Additionally, a cone with four or less sides would require greater care in locating the cone to direct traffic because it would be easy to orient the cone where a surface having a reflective member not in an orientation to accurately reflect the light incident on the cone by a vehicle and therefore is not easily viewable by a driver of a vehicle.

Advantages of the traffic cone 10 include:

a. Triangle base 12 with a lager cone width base providing a better target value for traveling public.

b. Polygonal shape of cone body 14 provides better reflectivity of light and deflection of wind or air to travel around and under cones.

c. Reflective member 18 may be a yellow reflective tape to emulate striping patterns on a roadway, or may be red reflective tape to be used to support road closure applications for lanes, roadways, highways, and freeways ramp closures. This allows transportation departments to develop and write procedures to implement use of yellow and red reflective tape on cones.

d. Reflective member 18 enhances reflectivity with more angles in the cone body 14.

Figure 5:
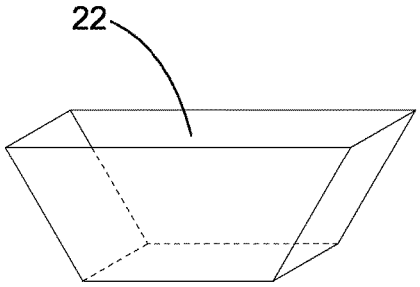
FIG. 5 is a foot cap of a traffic cone according to an embodiment.

The functionality of the traffic cone 10 includes:

a. TARGET VALUE—Larger diameter cone compared to industry standard for more visibility and better target value of cone b. WEIGHT—Standard cones used in industry is 71b. and 101b. The existing embodiments of the traffic cone 10 reduce the total weight without affecting the integrity to 6.51b and 9.51b.

c. Implementation of weighted foot caps 22 (see FIGS. 1 and 5) to eliminate the need for sand bags during high wind environments. The weighted foot caps 22 also increase stability of the traffic cone 10 by minimizing displacement caused by wind and/or moving traffic.

d. Recessed hand grooves 20 at the top of the traffic cone 10 and grooves 24 at the base 12 of the traffic cone 10 for greater ease of use and grip.

e. New cone design would allow the use of lighter cones in the industry for easier implementation for crews to install and more capacity of cones to be stacked in trucks to transport from job to job.

The dynamic property of the traffic cone 10 includes:

a. Smaller foot print b. Allows air to flow around and under with minimum impact to cone c. Stronger cone structure with ridged lines and angle patterns throughout cone The traffic cone 10 may have certain material requirements. For example, and without limitation, the traffic cone may include some or all of the following material requirements. Cones shall conform to the requirements of the MUTCD, shall be NCHRP 350 approved and shall be orange rubber or plastic. Cones shall have a maximum weight of 9 kg, including ballast. Standard cones shall be approximately 710 mm in height with a minimum conical bottom width of 250 mm. Standard cones shall have two horizontal circumferential stripes of white reflective sheeting, the upper a minimum of 150 mm wide, with the upper edge 75 to 100 mm from the top of the cone, and the lower a minimum of 100 mm wide with the upper edge approximately 50 mm below the upper stripe.

Tall cones shall be approximately 915 mm in height with a minimum conical bottom width of 250 mm. Tall cones shall have two horizontal circumferential stripes of white reflective sheeting, the upper a minimum of 150 mm wide, with the upper edge 75 to 100 mm from the top of the cone, and the lower a minimum of 100 mm wide with the upper edge approximately 50 mm below the upper stripe.

Extra tall cones shall be a minimum of 1050 mm in height with a minimum conical bottom width of 175 mm. Extra tall cones shall have a minimum of four horizontal circumferential stripes of reflective sheeting from 100-150 mm wide, of alternating orange and white starting with orange on the top. The upper edge of the sheeting shall be 100 mm from the top of the cone. Non-reflective spaces between the stripes shall not exceed 75 mm wide. Reflective sheeting shall conform to '730-05 Reflective Sheeting ASTM Type I or ASTM Type III. Reflective sheeting shall be firmly bonded to the cone with adhesive.

Embodiments of the present invention may also include a method of using a traffic cone. The method includes placing a cone in a roadway, wherein the cone comprises a triangular base; a cone body coupled to the base and extending from a top side of the triangular base and at least one reflective member coupled around a perimeter of the cone body, wherein the cone body comprises five or more surfaces forming a polygonal cone shape; reflecting light from the at least one reflective member from various angles corresponding to the angle of the surfaces of the cone body; and directing traffic by use of the cone.

The method may further includes additional steps, such as, but not limited to, comprising weighting the cone down with plurality of weighted feet; directing traffic away from a particular lane of traffic in response to using the traffic cone, wherein the at least one reflective member is yellow in color; supporting roadway closures, or ramp closure in response to using the traffic cone, therein the at least one reflective member is red in color; and holding a traffic cone in response to grasping recessed hand grooves of the traffic cone, wherein the recessed hand grooves are located on a top portion of the cone body.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A traffic cone system comprising:

a plurality of cones, each cone of a first portion of the plurality of cones comprises:

a base;

a cone body coupled to the base and extending from a top side of the base, wherein the cone body comprises five or more surfaces forming a polygonal cone shape; and at least one reflective member coupled around a perimeter of the cone body for traffic control, wherein the at least one reflective member is white in color, wherein the white color reflective member operates to direct a right side of a traffic lane;

each cone of a second portion of the plurality of cones comprises:

a base;

a cone body coupled to the base and extending from a top side of the base, wherein the cone body comprises five or more surfaces forming a polygonal cone shape; and at least one reflective member coupled around a perimeter of the cone body for traffic control, wherein the at least one reflective member is yellow in color, wherein the yellow color reflective member operates to direct a left side of a traffic lane; and each cone of a third portion of the plurality of cones comprises:

a base;

a cone body coupled to the base and extending from a top side of the base, wherein the cone body comprises five or more surfaces forming a polygonal cone shape; and at least one reflective member coupled around a perimeter of the cone body for traffic control, wherein the at least one reflective member is red in color, wherein the red color reflective member operates to stop traffic for a road closure.

2. The traffic cone system of claim 1, wherein the base of each cone is triangular in shape.

3. The traffic cone system of claim 1, wherein each cone further comprises weighted feet coupled to a bottom side of the base.

4. The traffic cone system of claim 1, wherein each cone further comprises recessed hand grooves at a top portion of the cone body, wherein the recessed hand grooves provide a grip for carrying the traffic cone.

5. The traffic cone system of claim 1, wherein each cone further comprises grooves in the base, wherein the grooves provide a grip for carrying the traffic cone.

6. A traffic cone system comprising:

a plurality of traffic cones, each cone of a first portion of the plurality of cones comprises:

a base;

a cone body having eight surfaces forming an octagonal cone shape coupled to the base, wherein the cone body extends from a top side of the base;

at least one reflective member coupled around a perimeter of the cone body, wherein the at least one reflective member is white in color, wherein the white color reflective member operates to direct a right side of a traffic lane;

each cone of a second portion of the plurality of cones comprises:

a base;

a cone body coupled to and extending from a top side of the base;

at least one reflective member coupled around a perimeter of the cone body, wherein the at least one reflective member is yellow in color, wherein the yellow color reflective member operates to direct a left side of a traffic lane; and each cone of a third portion of the plurality of cones comprises:

a base;

a cone body coupled to and extending from a top side of the base;

at least one reflective member coupled around a perimeter of the cone body, wherein the at least one reflective member is red in color, wherein the red color reflective member operates to stop traffic for a road closure.

7. The traffic cone system of claim 6, wherein each cone further comprises recessed hand grooves at a top portion of the cone body, wherein the recessed hand grooves provide a grip for carrying the traffic cone.

8. The traffic cone system of claim 6, wherein each cone further comprises grooves in the base, wherein the grooves provide a grip for carrying the traffic cone.

9. The traffic cone system of claim 6, further comprising feet, wherein the feet of each cone are weighted feet.

10. A method of using a traffic cone system, the method comprising:

placing a plurality of cones in a roadway, wherein each cone comprises a base; a cone body coupled to the base and extending from a top side of the base and at least one reflective member coupled around a perimeter of the cone body, wherein the cone body comprises five or more surfaces forming a polygonal cone shape;

reflecting light from the at least one reflective members of the plurality of cones from various angles corresponding to the angle of the surfaces of the cone body of each cone of the plurality of cones; and directing traffic by use of the plurality of cones, wherein directing traffic includes:

directing traffic from a right side of a traffic lane using a first portion of the plurality of cones having at least one reflective member that is white in color;

directing traffic from a left side of a traffic lane using a second portion of the plurality of cones having at least one reflective member that is yellow in color; and stopping traffic for a road closure using a third portion of the plurality of cones having at least one reflective member that is red in color.

11. The method of claim 10, further comprising weighting the cone down with plurality of weighted feet.

12. The method of claim 10, further comprising holding a traffic cone in response to grasping recessed hand grooves of the traffic cone, wherein the recessed hand grooves are located on a top portion of the cone body.

* * * * *